US006449964B1

(12) United States Patent
Cho et al.

(10) Patent No.: US 6,449,964 B1
(45) Date of Patent: Sep. 17, 2002

(54) REGENERATIVE REFRIGERATION SYSTEM WITH MIXED REFRIGERANTS

(75) Inventors: Young I. Cho, Cherry Hill, NJ (US); Cheolho Bai, Taegu (KR)

(73) Assignee: Vortex Aircon, Cherry Hill, NJ (US)

( * ) Notice: Subject to any disclaimer, the term of this patent is extended or adjusted under 35 U.S.C. 154(b) by 0 days.

(21) Appl. No.: 09/954,613

(22) Filed: Sep. 18, 2001

Related U.S. Application Data

(63) Continuation-in-part of application No. 09/608,656, filed on Jun. 30, 2000.

(51) Int. Cl.[7] ..... F25B 1/00; F25B 5/00
(52) U.S. Cl. ..... 62/114; 62/501
(58) Field of Search ..... 62/114, 115, 498, 62/501, 512

(56) References Cited

U.S. PATENT DOCUMENTS 4,136,528 A * 1/1979 Vogel et al. ..... 62/174
4,914,921 A * 4/1990 Knodel ..... 62/59
4,972,676 A * 11/1990 Sakai ..... 62/18
5,702,632 A * 12/1997 Weng ..... 252/67

* cited by examiner

*Primary Examiner*—William C. Doerrler
*Assistant Examiner*—Malik N. Drake
(74) *Attorney, Agent, or Firm*—Ostrolenk, Faber, Gerb & Soffen, LLP

(57) ABSTRACT

A regenerative type of refrigeration system recirculates a mixture of R-134a, R-32 and R-125 through first and second series condensers. In order to increase the concentration of the high-boiling point R-134a, the liquid output of a liquid-vapor separator receives a super-heated mixture vapor tapped from the output of the compressor. An adjustable valve controls the amount of the super heated mixture vapor which is injected to vary the concentration of R-134a in the recirculation line. Liquified R-134a passes through a secondary expansion valve and a secondary evaporator, reducing to an intermediate pressure, and enters a vortex tube, thus bypassing the main evaporator. Subsequently, the suction pressure of the compressor increases, increasing the EER of the refrigeration system. The recirculating concept is also applicable to a single refrigerant system.

24 Claims, 9 Drawing Sheets

REGENERATIVE REFRIGERATION SYSTEM WITH MIXED REFRIGERANTS

CROSS REFERENCE TO RELATED APPLICATIONS

This is a continuation-in-part of U.S. patent application Ser. No. 09/608,656, filed Jun. 30, 2000 in the name of Young I. Cho and Cheolhi Bai and entitled REGENERATIVE REFRIGERATION SYSTEM WITH MIXED REFRIGERANTS.

FIELD OF THE INVENTION

This invention relates to refrigeration apparatus and a refrigeration process and more specifically relates to a novel refrigeration apparatus and process employing a mixture of different refrigerants.

BACKGROUND OF THE INVENTION

Refrigeration systems are well known which employ a single refrigerant, for example, CFC refrigerants such as R-12 and HCFC refrigerants such as R-22. These refrigerants, however, have serious environmental drawbacks and are being replaced by refrigerants of the HFC type such as R-32, R-125 and R-134a in different combinations.

The individual HFC refrigerants have diverse characteristics, as shown in the following table:

| | DENSITY | BOILING POINT | LATENT HEAT ($H_{fg}$) | CONDENSER PRESSURE | EVAPORATOR PRESSURE | HEAT TRANSFER CHARACT. | FLAM-ABILITY |
|---|---|---|---|---|---|---|---|
| R-32 | Light | Low | Large | High | High | Good | Yes |
| R-125 | Heavy | Low | Small | High | High | Medium | No |
| R-134a | Medium | High | Medium | Low | Low | Poor | No |

In many refrigeration systems, the following characteristics are preferred:

Density—heavy

Boiling Point—low at evaporator and high at condenser

Latent Heat—large

Condenser Pressure—low

Evaporator Pressure—high

Heat Transfer—good

Flamability—no

In the above, $h_{fg}$ is the enthalpy difference between 100% vapor and 100% liquid.

R-32 is a preferred refrigerant because of its high latent heat and high evaporator pressure which reduces the compressor work and thus the compressor size. That is, the compressor work $W_{COMPRESSOR}$ is defined as:

$$W_{COMPRESSOR}=\int vdP$$

where v=specific volume=1/density; and

P=pressure.

In a typical system, as evaporator pressure increases, the pressure change in the compressor is reduced, thus reducing the compressor work.

While R-32 has the best thermal characteristics, it is more flammable than the others, and carries with it the danger of fire. Consequently, R-32 is commonly mixed with non-flammable fluids such as R-125 and R-134a to reduce the fire danger.

Currently available mixture refrigerants include R-407c and R-410a. The former (R-407c) is one of the R-407 series refrigerants, which include R-407a, R-407b, R-407c, etc. The R-407 series is made of three refrigerants R-32, R-125 and R-134a. The last letter in the designation of R-407 indicates different composition ratios of R-32, R-125 and R-134a. For example, R-407c is made of R-32, R-125 and R-134a at a ratio of 23:25:52 based on mass. Similarly, R-410a is one of the R-410 series refrigerants which are made of two refrigerants R-32 and R-125. The last letter "a" in R-410a indicates that a composition ratio of R-32 and R-125 is 50:50 by mass. Depending on the composition ratio, the last letter can vary.

Several new HFC type refrigerants such as R-134a, R-407c and R-410a are known in attempts to get the best trade-off of flammability versus thermal efficiency. The first R-134a has replaced R-12 for automotive air conditioners, refrigerators and large chillers. This refrigerant has relatively poor heat transfer characteristics but in a typical system produces a pressure of about 8 atm at the evaporator and 16 atm at the condenser. Thus, the relatively small ΔP at the compressor produces excellent efficiency. Therefore, this refrigerant has replaced R-12 for many applications, despite its poor heat transfer characteristics.

A second HFC type refrigerant is R-407c, which is a mixture of R-32, R-125 and R-134a in proportions of 23:25:52 respectively. This mixture, however, produces only about 6 atm at the evaporator and 20 atm at the condenser (like R-22) and has poor heat transfer characteristics due to the high proportion of R-134a.

A third HFC type refrigerant is R-410a, which is a mixture of R-32 and R-125 in a ratio of 50:50 respectively. This mixture, however, produces about 12 atm at the evaporator, but 30 atm at the condenser and requires a large compressor and compressor work.

It would be very desirable to provide a novel refrigeration system which would permit the use of a non-flammable mixture of refrigerants, a reduced condenser pressure and an increased evaporator pressure; and which takes the best advantage of the properties of the individual fluids of the mixture.

BRIEF DESCRIPTION OF THE INVENTION

In accordance with the invention, a novel system and refrigeration process is provided in which a first component (for example, R-134a) is recirculated in the condenser while the other component or components (for example, R-32 and R-125) are directed, without recirculation, to the evaporator to increase evaporator pressure and heat capacity. The composition of the circulating refrigerant may be controlled, as by a valve, in the recirculation path to effectively control thermal load variation.

In a preferred embodiment of the invention, the condenser is divided into two sections, with a vortex tube or other liquid-vapor separator between them to recirculate the liquid R-134a through the first condenser structure.

The vortex tube, or the like, between condenser sections will:

1. Promote liquification in the first condenser by recirculating R-134a rich liquid into the first condenser section;
2. Pass vapor to the second condenser section which is rich in R-32 and R-125;
3. Follow thermal load variation by controlling the amount of recirculating R-134a.

In the novel system, liquid is returned to the inlet of the condenser using the vortex tube as a pump. Other pumps can be used, including venturi tubes.

The advantages produced by the invention include:

1. The use of a non-flammable fluid;
2. A large heat capacity at evaporator;
3. A lower condenser pressure;
4. A higher vapor pressure in the evaporator, producing a lower specific volume v in the evaporator, thus reducing compressor work $\int vdP$.

As a result of the above, the system requires lower compressor work to reduce compressor size, and produces higher latent heat in the evaporator, producing a more efficient evaporator.

In accordance with the specific improvements of the instant application, several features are superimposed on the basic concepts.

Thus, in a first improvement, a superheated mixture vapor is taken from the compressor output and is injected into the liquid volume of a liquid-vapor separator, producing highly enriched R-134a in the regenerative line.

As a second improvement, the high boiling point refrigerant component, for example, R-134a is recirculated around both the compressor and the condenser producing increased subcooling of the R134a component. At the same time the suction pressure of the compressor is increased through the use of a secondary expansion device which reduces condenser pressure to an intermediate value that is still greater than the evaporator pressure. The benefit of this improvement is increased subcooling, increased suction pressure at the compressor, and increased EER.

As a still further improvement and also to obtain increased subcooling, increased suction pressure at the compressor and increased EER, the novel regenerative concept can also be applied to a single refrigerant system such as R-22 only.

In general, in order to increase the concentration of the high-boiling point refrigerant (i.e., R-134a) in the liquid of the liquid-vapor separator, a superheated mixture vapor tapped from a line between the compressor and the first condenser is directly injected to a liquid inside the liquid-vapor separator. An adjustable valve controls the amount of the superheated mixture vapor injected so that one can vary the concentration of the high-boiling point refrigerant (i.e., R-134a) in the recirculation line.

DETAILED DESCRIPTION OF THE DRAWINGS

Refrigeration systems are well known and systems using vortex tube arrangements for improving the efficiency of the system are shown in our U.S. Pat. No. 6,164,086 and copending application Ser. No. 09/535,126, filed and Mar. 28, 2000, respectively, the contents of which are included herein by reference.

The coefficient of performance ("COP") of a refrigeration system, sometimes termed the energy-efficiency ratio (EER), equals $Q_V/W_C$, where $Q_v$ is the heat absorption by the evaporator of the system and $W_C$ is the work done by the compressor. Thus, any system which decreases $W_C$ and increases $Q_V$ will increase COP and EER. To illustrate this concept, FIG. 1 shows a diagram of a refrigeration system and FIG. 2 shows a temperature-entropy diagram of the refrigeration system.

Figure 1:
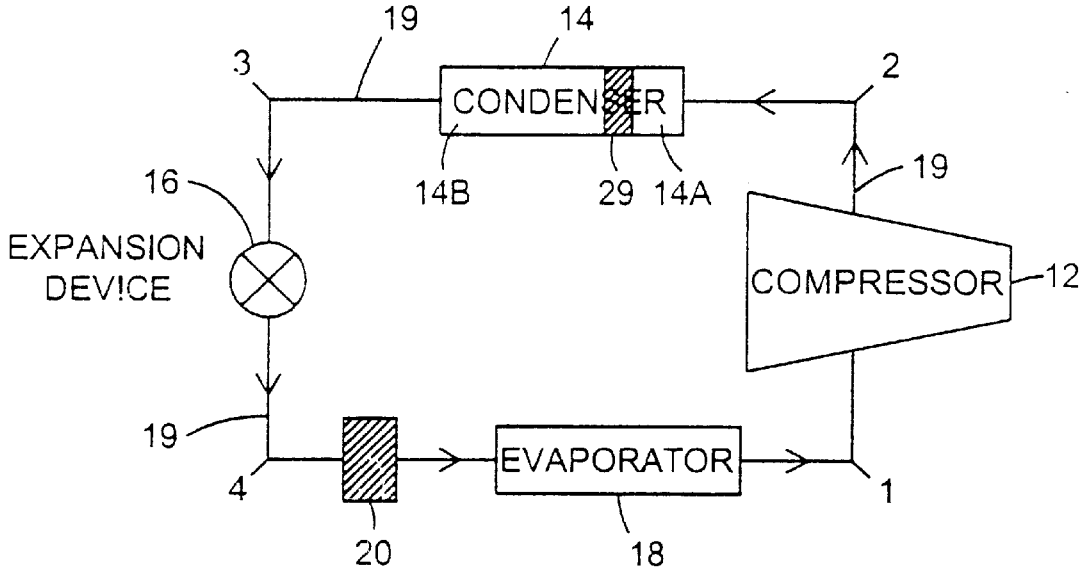
FIG. 1 shows a known type of refrigeration system which may employ a single refrigerant or a mixture of refrigerants.

The refrigeration system shown in FIG. 1 includes a compressor 12, a condenser 14, an expansion device 16 and an evaporator 18. The various components are connected together via copper tubing 19.

The refrigeration system is a closed loop system that circulates a refrigerant through the various elements. Some commonly used types of refrigerant include R-12, R-22, R-134a, R-407c, R-410a, ammonia, carbon dioxide and natural gas. A refrigerant is continuously cycled through the refrigeration system. The main steps in the refrigeration cycle are compression of the refrigerant by the compressor, heat rejection of the refrigerant in the condenser, throttling of the refrigerant in the expansion device, and heat absorption by the refrigerant in the evaporator. As indicated previously, this process is referred to as the vapor compression refrigeration cycle.

Figure 2:
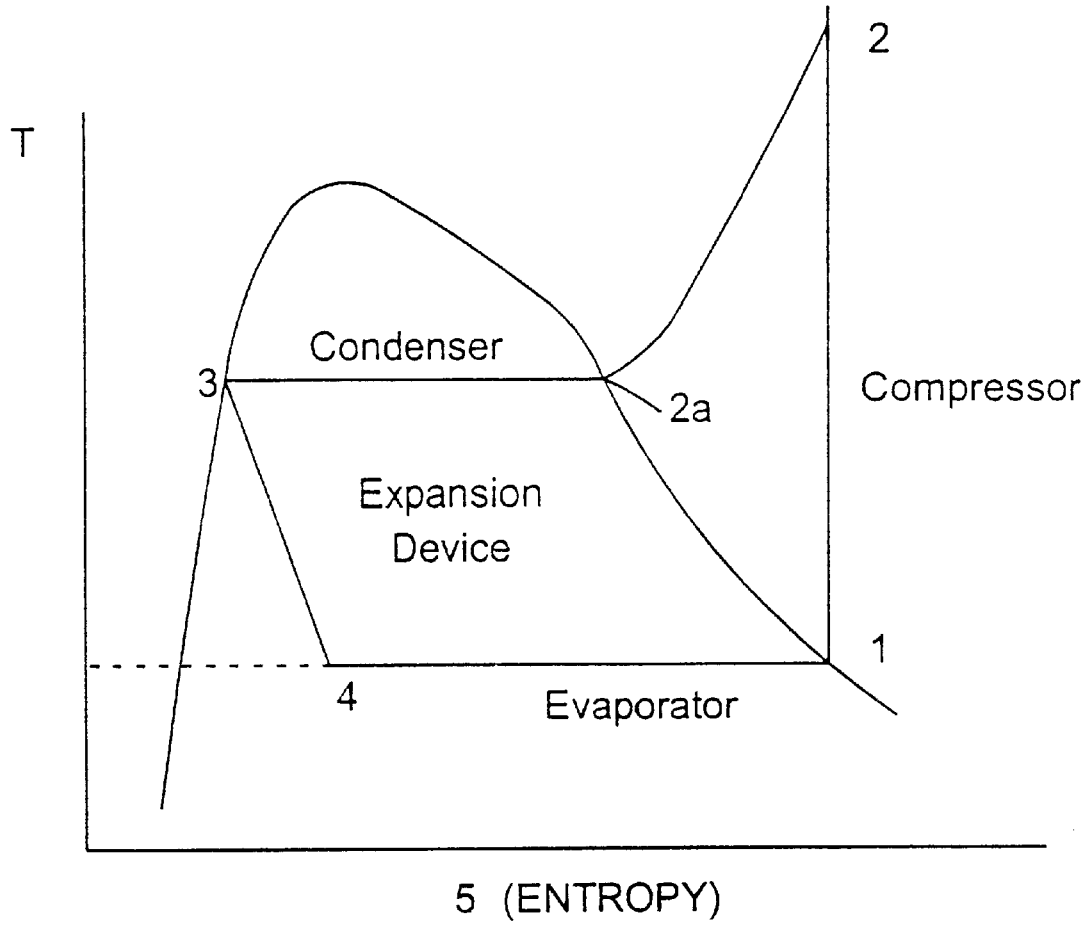
FIG. 2 is a temperature-entropy curve of the refrigeration system of FIG. 1.

The temperature-entropy curve of a typical refrigeration cycle is illustrated in FIG. 2. Point 2 is where the refrigerant exists as a superheated vapor. As the superheated vapor cools inside the condenser 14, the superheated vapor becomes a saturated vapor (point 2*a*). As heat transfer to the ambient air continues in the condenser 14, the refrigerant becomes a saturated liquid at point 3. After going through the expansion device 16, the refrigerant becomes a mixture of approximately 20% vapor and 80% liquid at point 4. As the refrigerant absorbs heat in the evaporator 18, the refrigerant becomes a saturated or slightly superheated vapor at the suction pressure at point 1. These points are also indicated on FIG. 1.

As previously stated, the efficiency of a refrigeration cycle (and by analogy a heat pump cycle) depends primarily on the heat absorption from the evaporator 18 and the work of the compressor 12. The compressor work depends on the difference between the head and suction pressures of compressor 12. The pressure of the refrigerant as it enters the compressor 12 is referred to as the "suction pressure level" and the pressure of the refrigerant as it leaves the compressor 12 is referred to as the "head pressure level". Depending on the type of refrigerant used, the head pressure can range from about 170 PSIG (12 atm) to about 450 PSIG (30 atm).

Compression ratio is the term used to express the pressure difference between the head pressure and the suction pressure. Compression ratio is calculated by converting the head pressure and the suction pressure onto an absolute pressure scale and dividing the head pressure by the suction pressure. When the compression ratio increases, the compressor efficiency drops thereby increasing energy consumption. In most cases, the energy is used by the electric motor that drives the compressor. In addition, when compression ratio increases, the temperature of the refrigerant vapor increases to the point that oil for lubrication may be overheated which may cause corrosion in the refrigeration system.

When a compressor such as compressor 12 runs at a high compression ratio, it no longer has the capability to keep a refrigerated space or living space at the designated temperature. As the compressor efficiency drops, more electricity is used for less refrigeration. Furthermore, running the compressor at a high compression ratio increases the wear and tear on the compressor and decreases its operating life.

An evaporator such as evaporator 18 is made of a long coil or a series of heat transfer panels which absorb heat from a volume of air that is desired to be cooled. In order to absorb heat from this ambient volume, the temperature of the refrigerant must be lower than that of the volume. The refrigerant exiting the expansion device 16 consists of low quality vapor, which is approximately 20% vapor and 80% liquid.

The liquid portion of the refrigerant is used to absorb heat from the desired volume as the liquid refrigerant evaporates inside the evaporator 18. The vapor portion of the refrigerant is not utilized to absorb heat from the ambient volume. In other words, the vapor portion of the refrigerant does not contribute to cooling the ambient volume and decreases the efficiency of the refrigeration cycle.

As further shown in FIG. 1, a vortex tube 20 may be placed between the expansion device 16 and the evaporator 18. Vortex tube 20 converts at least a portion of the refrigerant vapor that exits the expansion device into liquid so that it can be used in the evaporator to absorb heat from the ambient volume. Vortex tubes are generally well-known but are not commonly found in refrigeration systems. The vortex tube is a device which is often used to convert a flow of compressed gas into two streams—one stream hotter than and the other stream colder than the temperature of the gas supplied to the vortex tube. A vortex tube does not contain any moving parts.

A high pressure gas stream enters the vortex tube tangentially at one end. The high pressure gas stream produces a strong vortex flow in the tube. The vortex flow is similar in shape to a helix. The high pressure gas separates into two streams having different temperatures, one along the outer wall and one along the axis of the tube. In the outer stream, the circumferential velocity is inversely proportional to the radial position. The pressure within a vortex tube is lowest at the center of the tube and increases to a maximum at the wall.

The pressure gas that enters a vortex tube 20 will be the refrigerant in a refrigeration cycle. Vapor refrigerant is a compressible and condensable medium. The pressure within the vortex tube 20 decreases at the core of the vortex tube due to the vortex motion, resulting in the corresponding temperature drop. Hence, the condensable refrigerant vapor undergoes vapor-liquid phase change at the core of the vortex tube 20, thus increasing the liquid fraction of the refrigerant at the inlet of the evaporator and subsequently increasing the heat absorption capacity in the evaporator.

The condenser 14 in the refrigeration cycle is used to convert superheated refrigerant vapor to liquid by rejecting heat to the surroundings. The condenser is a long heat transfer coil or series of heat rejecting panels similar in appearance to the evaporator. Referring again to FIG. 1, as refrigerant enters the condenser 14, the superheated vapor first becomes saturated vapor in the approximately first quarter-section of the condenser, and the saturated vapor undergoes phase change in the remainder of the condenser at approximately constant pressure.

Since the heat rejection from the condenser to the surroundings can occur only when the temperature of the refrigerant is greater than that of the surroundings, the refrigerant temperature has to be raised well above that of the surroundings. This is accomplished by raising the pressure of the refrigerant vapor, a task that is done by the compressor 12. Since vapor temperature is closely related to vapor pressure, it is critically important that the condenser efficiently rejects heat from the refrigerant to the surroundings. If the condenser 14 is not efficient, the compressor 12 has to further increase the head pressure in an attempt to assist the condenser in dumping heat to the surroundings.

A vortex tube 29 in FIG. 1 may be placed in the condenser to assist to convert saturated refrigerant vapor to liquid thus increasing the condenser's efficiency. The first approximately one-quarter of the condenser is represented by 14A and the remaining three-quarters of the condenser is represented by 14B.

The vortex tube 29 may be inserted approximately one-quarter of the way into the condenser (i.e., at the point where the superheated vapor becomes saturated vapor in full or in part). By inserting the vortex tube 29 in an existing condenser, manufacturing costs may be minimized. However, for all intents and purposes two separate condensers, each about the respective size of condenser portions 14A and 14B, may be used.

When a vortex tube 29 is placed approximately one-quarter of the way from the inlet of the condenser, the temperature of the refrigerant does not have to be raised well over that of the surroundings, thus allowing the compressor to run at a lower head pressure than would be the case without the vortex tube 29.

Figure 3:
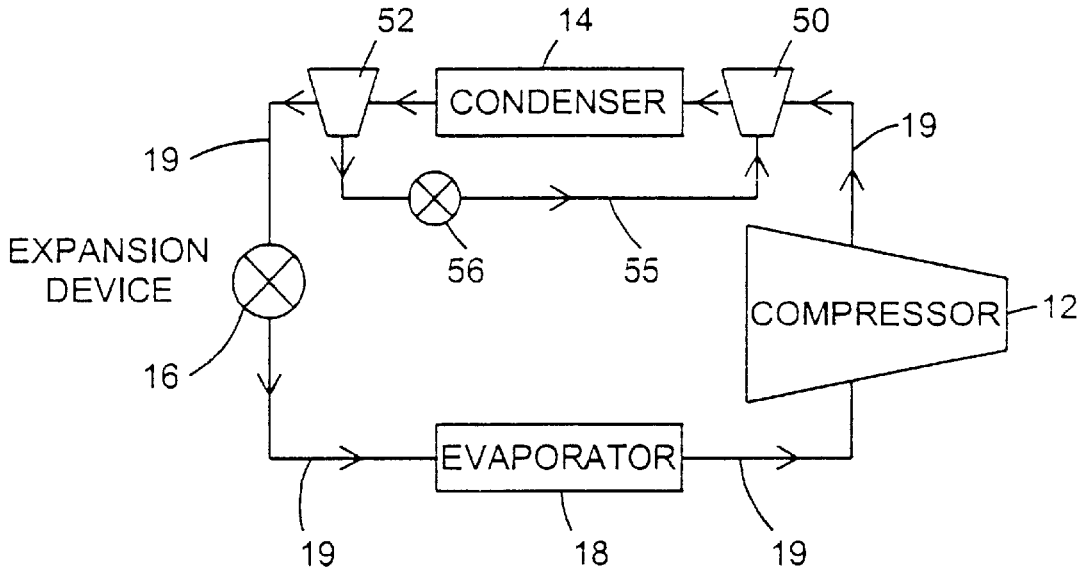
FIG. 3 shows a first embodiment of the novel refrigeration system of the invention.
Figure 4:
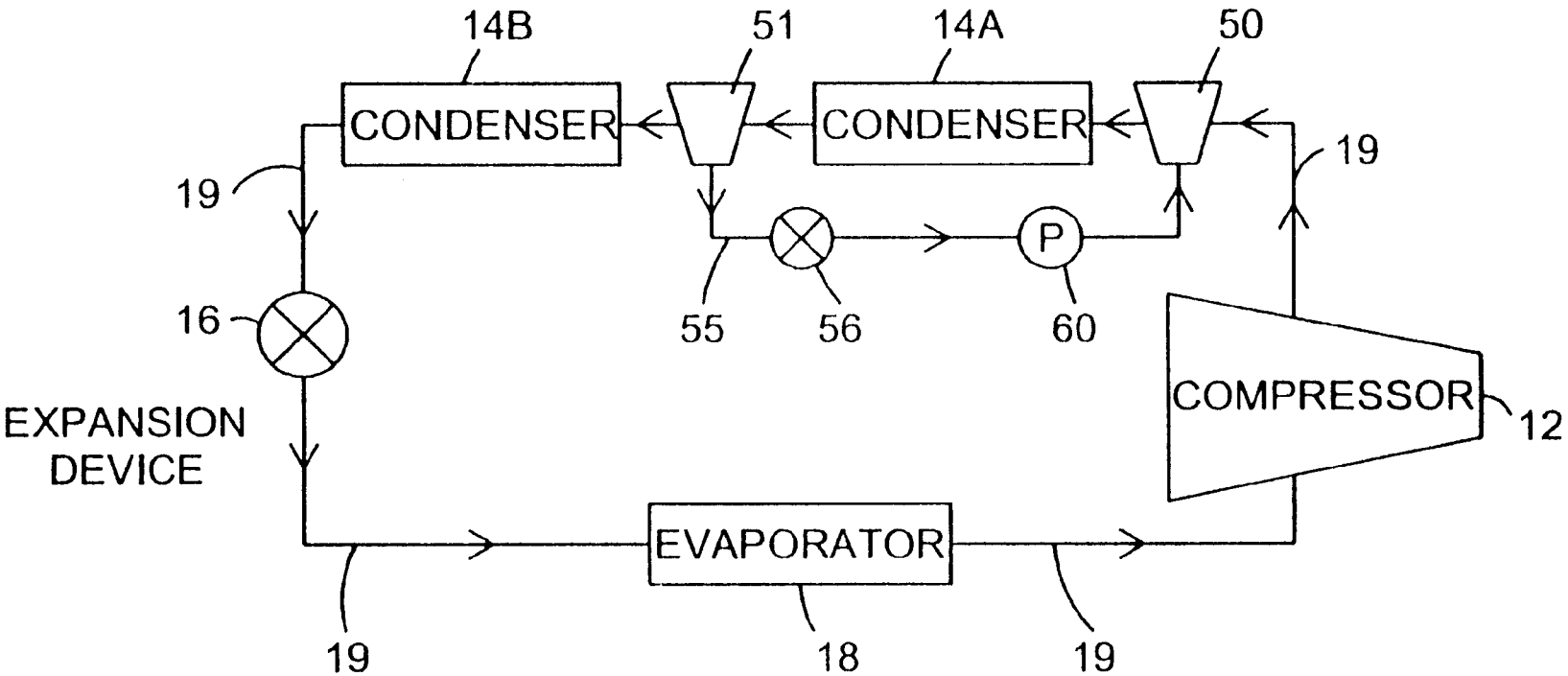
FIG. 4 shows a second embodiment of the novel system of the invention.

The improvement of the present invention is shown in FIGS. 3 and 4 where components similar to those in FIG. 1 are given the same identifying numerals. For the case of R-407c in FIGS. 3 and 4, the circulating refrigerant at the inlet of the condenser 14 has a mixture ratio of 23:25:52 of R-32, R-125 and R-134a. However, the circulating refrigerant after the condenser has a mixture ratio of, for example, 34:36:30 of R-32, R-125 and R-134a due to the recirculation of the R-134a around the condenser. This increases the mass fraction of both the R-32 and R-125 in the evaporator, the improvement of the present invention.

As shown in FIG. 3, in accordance with the invention, a first vortex tube 50 is placed at the inlet of condenser 14 and a second vortex tube 52 is placed at its outlet end. The inlet of vortex tube 50 is connected to compressor 12, receiving the components of R-134a, R-32 and R-125, all in the vapor phase. The condenser 14 will liquify all refrigerant vapors. The vortex tube 52 separates liquid refrigerants by density difference. A recirculation path 55 is connected from the liquid outlet of vortex tube 52 through a control valve 56 to the fluid inlet of vortex tube 50. Note that vortex tube 50 could be a venturi which can suck in liquid from pathway 55. The vortex tube 52 in FIG. 3 can be replaced by other liquid separators such as a device based on centrifugal force.

FIG. 4 shows the novel system of the invention with a split condenser 14A and 14B. Thus, in FIG. 4 the vortex tube 51 is disposed between the condenser sections 14A and 14B. The condenser 14A in FIG. 4 will selectively liquify at least a portion of the R-134a, which has the highest boiling temperature in the mixture. The liquid R-134a is then separated by the vortex tube 51 into its liquid R-134a component and the R-32 vapor and R-125 vapor components. A recirculation path 55 is connected from the liquid outlet of vortex tube 51 through a control valve 56 to the fluid inlet of vortex tube 50. Some liquid R-134a may also pass through the vortex tube 51. The condenser 14B liquefies the R-32 and R-125 vapors exiting vortex tube 51. Note that the vortex tube 51 in FIG. 4 can be replaced by other liquid-vapor separators. FIG. 4 also shows a pump 60 which may be added to the system to pump the R-134a liquid around the recirculation path 55.

As shown in FIGS. 3 and 4, by recirculating the R-134a around condenser 14, the condenser side pressure is significantly reduced, for example, from 30 atm to 20 atm. Further, as the R-32 and R-125 move to the evaporator, the evaporator side pressure becomes 12 atm, thus reducing $W_{COMPRESSOR}$. The valve 56 in FIGS. 3 and 4 is employed to effectively follow thermal load variations in the system.

Figure 5:
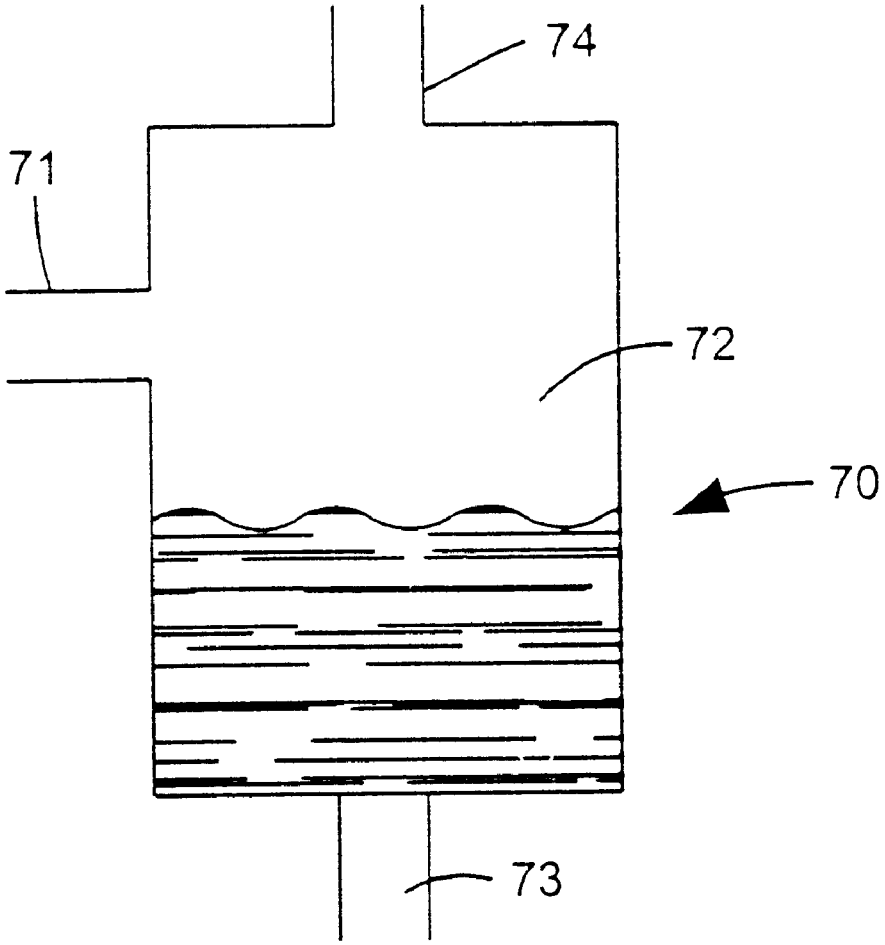
FIG. 5 shows a schematic cross-section of a liquid vapor separator which can be used in place of the vortex tube of FIG. 4.

FIG. 5 shows a conventional liquid-vapor separator 70 in which the refrigerant mixture is applied to inlet 71. Liquid settles in chamber 72 and is withdrawn from outlet 73, while the remaining R-32 and R-125 vapor is withdrawn from outlet 74.

Figure 6:
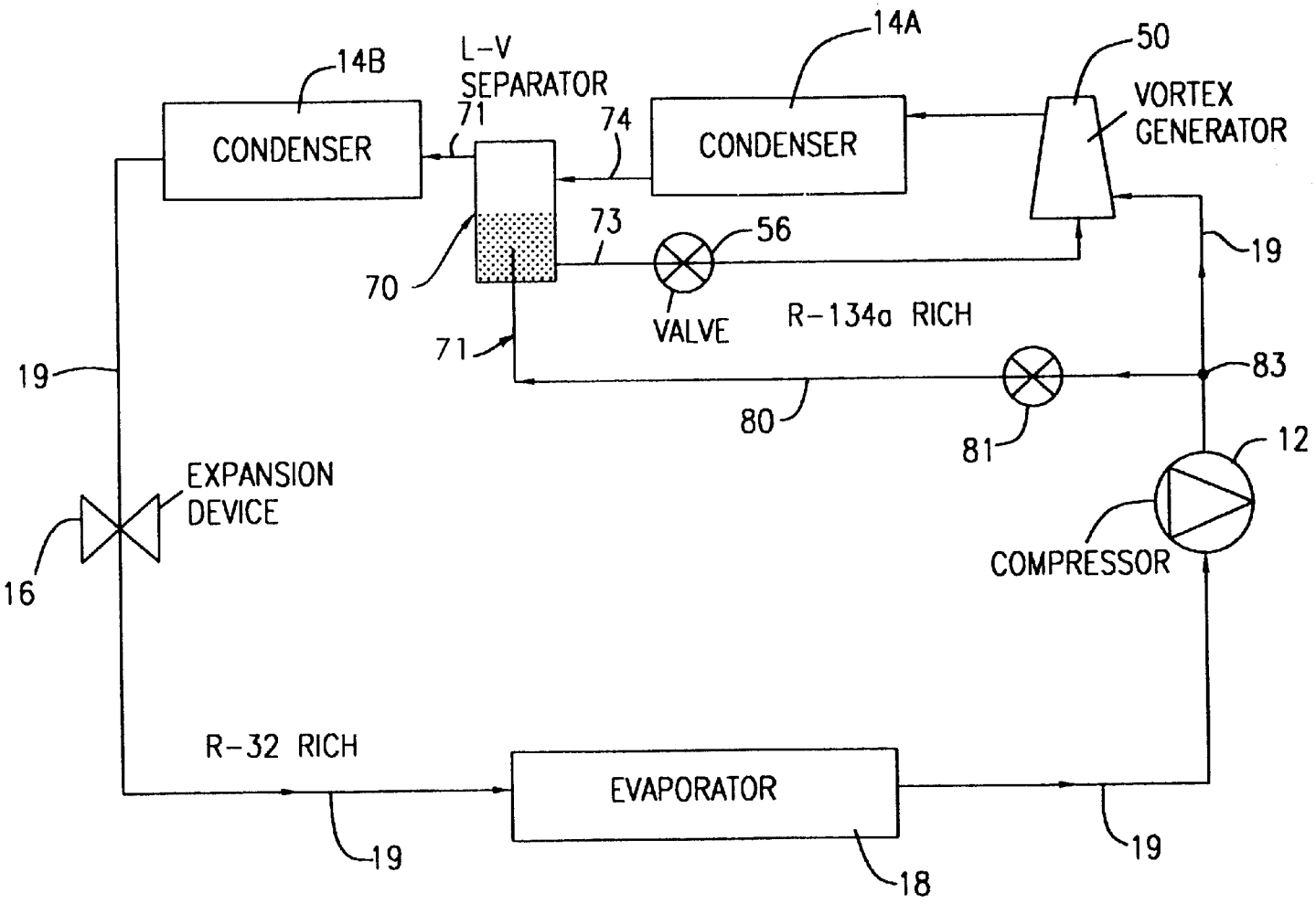
FIG. 6 shows an embodiment of the improvement of the present invention to preheat the liquid to be recirculated in the regenerative line.

Referring next to FIG. 6, the structure therein is an improvement of that of FIGS. 3 and 4 and similar components carry similar numerals. Note that the compressor 12 symbol is slightly changed to avoid possible confusing with the vortex tube.

In FIG. 6, the vortex tube 51 of FIG. 4 is replaced by the liquid/vapor separator 70 of FIG. 5. Significantly, a conduit 80 containing an adjustable valve 81 is coupled from the output of compressor 12 to an input 71 of separator 70. Thus, a super-heated mixture vapor tapped at point 83 between the compressor 12 and vortex generator 509 is directly injected into the liquid-vapor separator. Adjustable valve 81 controls the mass flow rates of super heated vapor to liquid-vapor separator 70. This produces a more highly concentrated R-134a in the regenerative line to vortex generator 50.

More specifically, in FIG. 6, heat is added to the liquid inside liquid-vapor separator 70 so that the low-boiling point refrigerant (i.e., R-32) can evaporate, leaving a high-boiling point refrigerant (i.e., R-134a) behind. Using this method, one may obtain approximately 80% high-boiling point R-134a in the liquid of the liquid-vapor separator 70.

Figure 7:
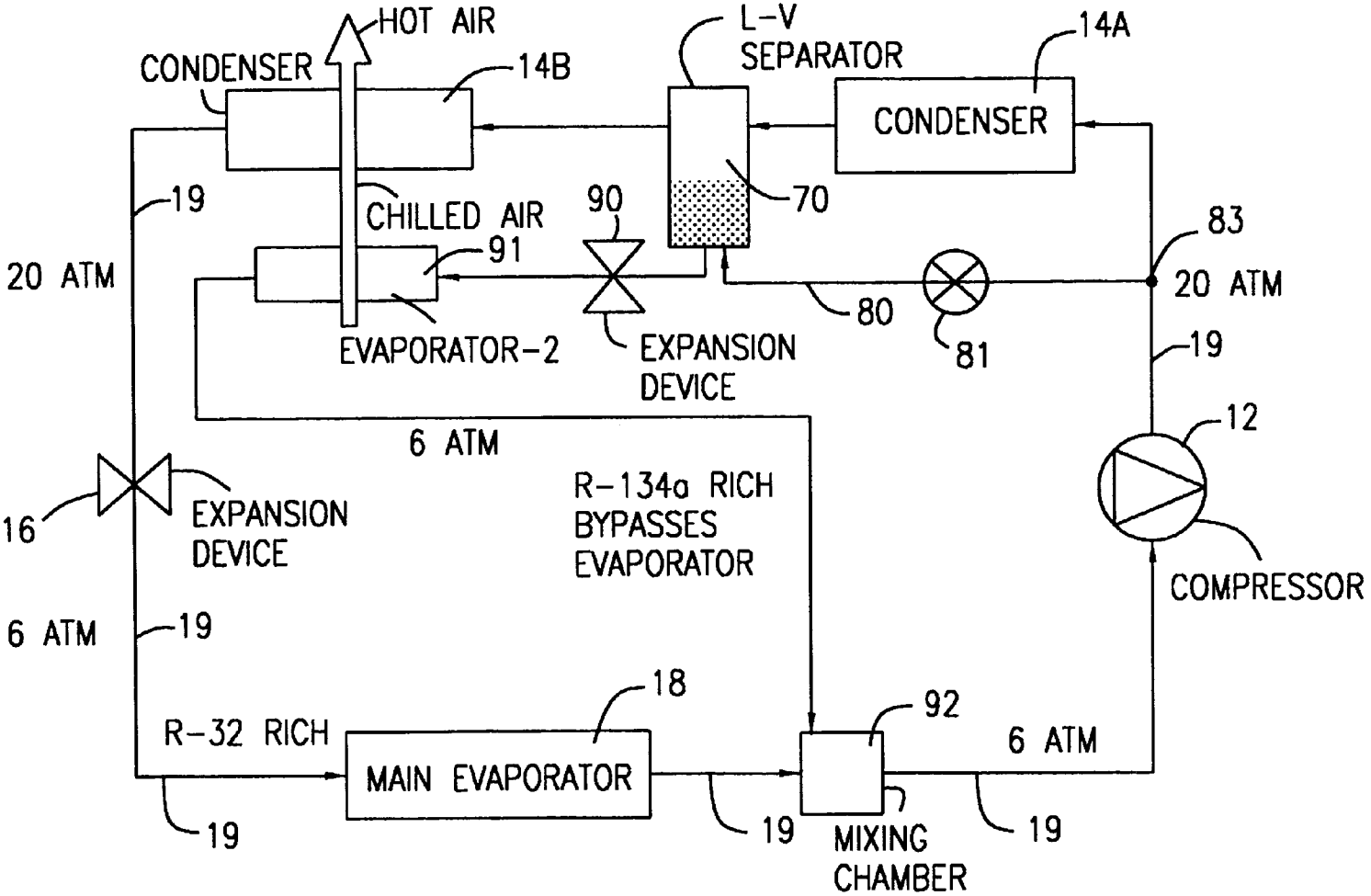
FIG. 7 shows a further embodiment of the improvement of the invention in which the high boiling point refrigerant is recirculated through a secondary expansion device and evaporator.

FIG. 7 shows a further improvement of the system of FIG. 6. Thus, the vortex generator 50 of FIG. 6 is removed, and the recirculation path is modified such that the discharged liquid of liquid/vapor separator 70 flows through a secondary expansion device 90 and a secondary evaporator 91 to mixing chamber 92 and then to the input of compressor 12. The object of the system of FIG. 7 is to cause recirculated R-134a to bypass main evaporator 18.

Thus, liquid refrigerant of R-134a from the liquid-vapor separator 70 passes through the secondary expansion device 90, decreasing its temperature. The cold mixture then enters the secondary evaporator 91, where warm air is chilled to a chilled air. The chilled air enters the condenser 14B, making the condenser 14B more efficient, and producing increased subcooling of the recirculating R-134a. Note that condenser 14B and secondary evaporator 91 can each be any desired type of heat exchanger.

In order to increase the concentration of the high-boiling point refrigerant, R-134a in the liquid of the liquid-vapor separator 70, a superheated mixture vapor tapped from the junction 83 between the compressor 12 and the first condenser 14*a* is directly injected to the liquid inside the liquid-vapor separator 70. Adjustable valve 81 controls the amount of the superheated mixture vapor injected so that one can vary the concentration of the high-boiling point refrigerant (i.e., R-134a) in the recirculation line.

Figure 8:
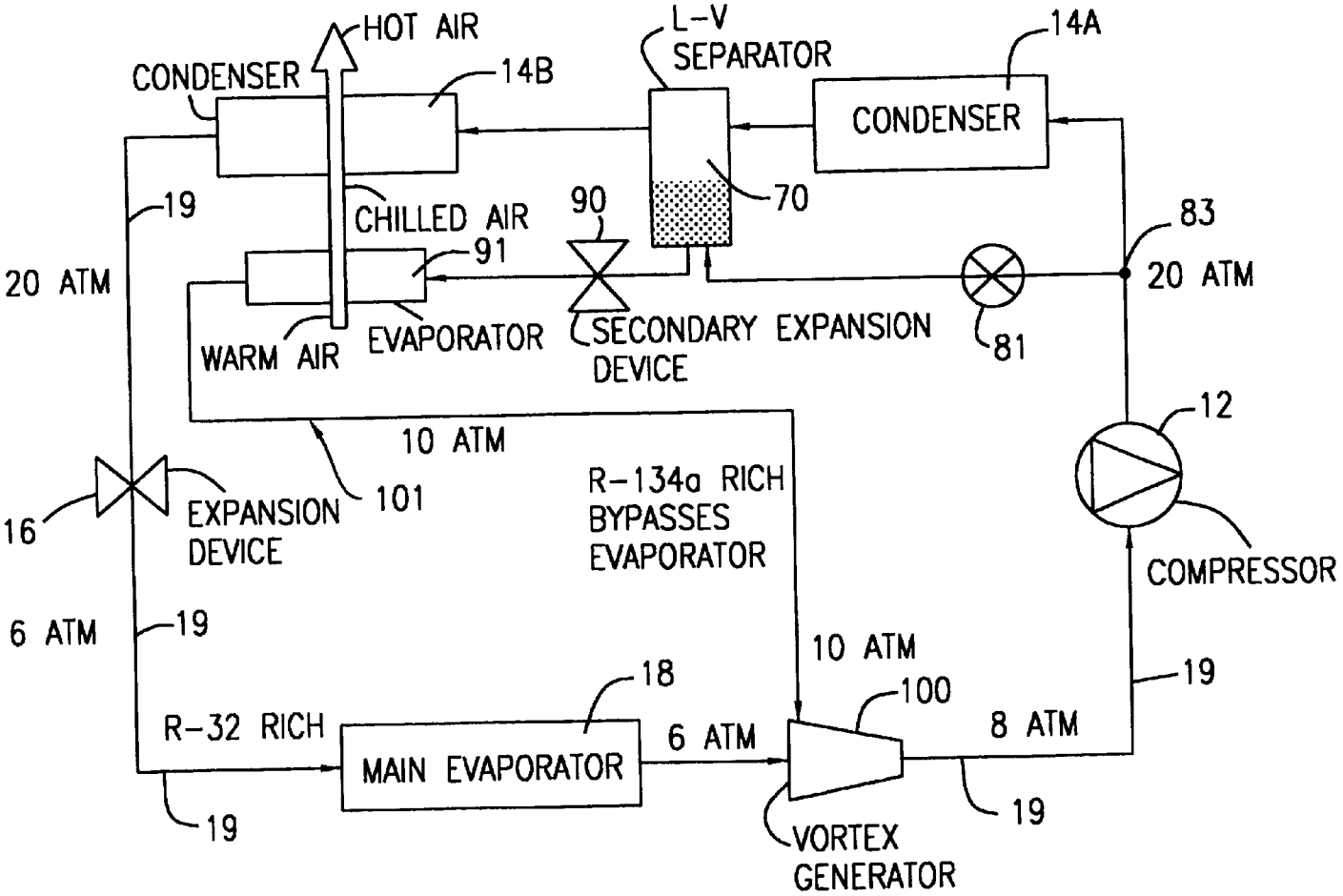
FIG. 8 shows a still further embodiment of the invention in which suction pressure of the compressor is increased to increase subcooling and to be decreased pressure differential across compressor.

FIG. 8 is similar to the system of FIG. 7, but mixing chamber 92 is replaced by a vortex generator 100, and pressures are adjusted to increase the EER of the system.

Thus, in FIG. 8, the objective is to increase the suction pressure of the compressor 12, using the pressure of a high-boiling point refrigerant (i.e., R-134a) vapor from the secondary evaporator 91. By selecting an expansion device 90, one can reduce the refrigerant pressure in line 101 to an intermediate value that is greater than the main evaporator 18 pressure. In FIG. 8 as an example, the secondary expansion device 90 reduces the condenser pressure of 20 atm at point 83 to 10 atm in line 101 through the secondary expansion device 90, whereas the condenser 14B pressure reduces from 20 atm to 6 atm through the main expansion device 16. As the cold mixture at 10 atm passes through the secondary evaporator 91, the cold mixture R-134a becomes all vapor, and chilled air is produced, as labeled, which is used to increase the performance of the condenser 14B, thus increasing subcooling or alternatively to cool a refrigerated space. The R-134a vapor then bypasses the main evaporator 18 and enters vortex generator 100, creating a vacuum at the core of the vortex generator 100. Because of this vacuum, the low-pressure vapor from the main evaporator 18 (at 6 atm) can be sucked into the vortex generator and mixed with the high-pressure vapor from the secondary evaporator 91. As a result the refrigerant pressure exiting the vortex generator 100 becomes greater than 6 atm, for example, 8 atm. Thus, the suction pressure of compressor 12 increases, and accordingly the compressor work is reduced, to produce increased subcooling and to increase the EER of the refrigeration system.

Figure 9:
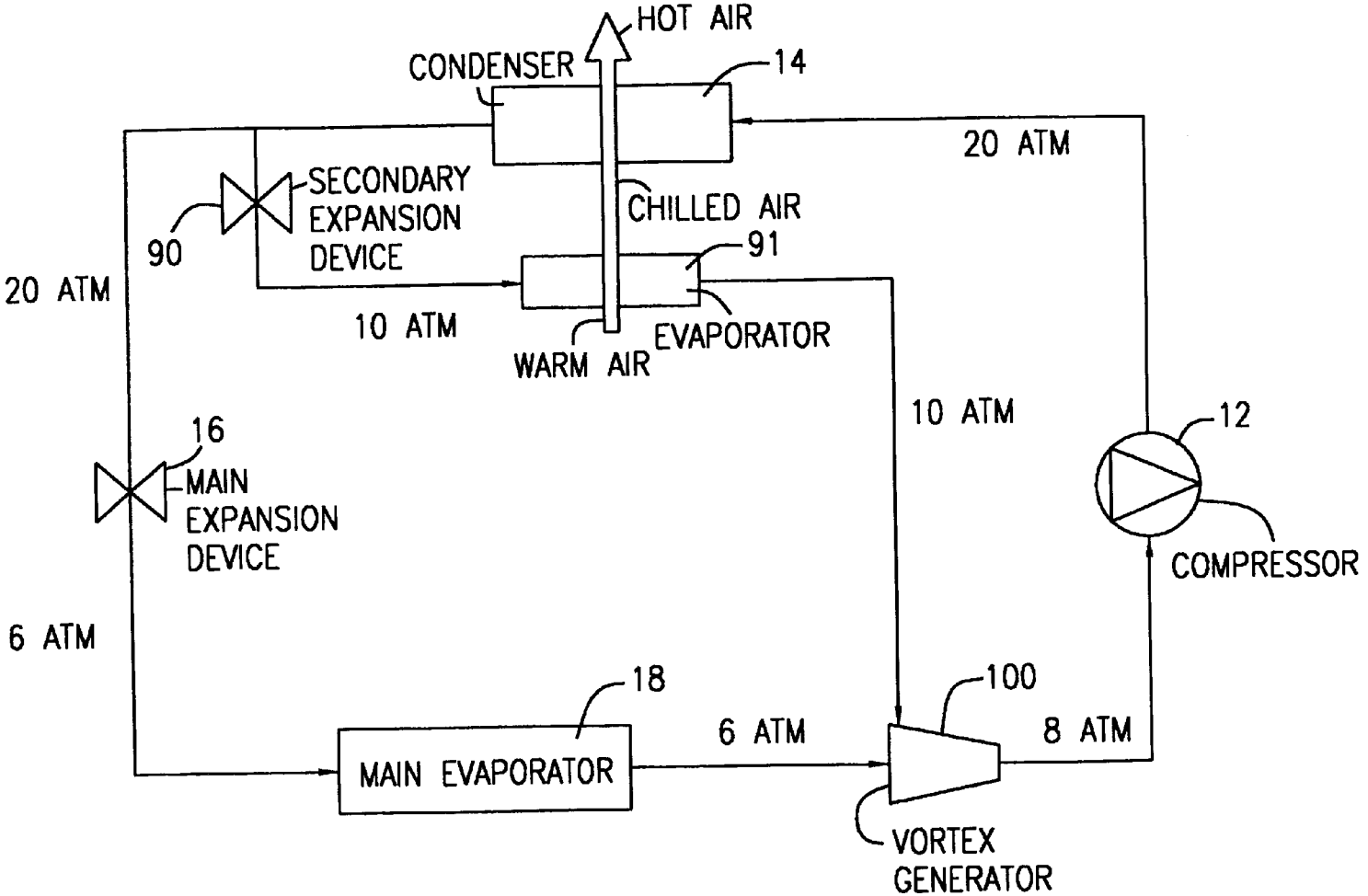
FIG. 9 shows yet another embodiment of the invention as applied to a single refrigerant system.

The novel regenerative principle of FIGS. 7 and 8 can be applied to a single refrigerant system, (i.e. R-22 only) as shown in FIG. 9, where numerals used in FIGS. 1 through 8 are repeated to identify similar components. The objective in FIG. 9 is to increase the suction pressure of compressor 12 using the pressure of the refrigerant vapor from the secondary evaporator 91. Note that a new recirculation path is provided from condenser 14, through secondary expansion device 90, through secondary evaporator 91, to vortex generator 100. Note also the pressures in the system which track the pressures shown in FIG. 8. By selecting a suitable expansion device 90 one can reduce the condenser 14 pressure to an intermediate value that is greater than the main evaporator 18 pressure. As in FIG. 8, the secondary expansion device reduces the condenser pressure of 20 atm to 10 atm through the secondary expansion device, whereas the condenser pressure output reduces from 20 atm to 6 atm through the main expansion device 16. As the cold mixture at 10 atm passes through the secondary evaporator 91, the cold mixture becomes all vapor, and the chilled air produced is used to increase the performance of the condenser 14.

Thus, increased subcooling results. Alternatively, the chilled air can be used to cool a refrigerated space.

Then, as before, the vapor bypasses the main evaporator 18 and enters vortex generator 100, creating a sufficient vacuum at the core of the vortex generator. Because of the vacuum created by the bypassed vapor, the low-pressure vapor from the main evaporator 18 at 6 atm can be sucked into the vortex generator 100 and mixed with the high-pressure vapor from the secondary evaporator 91. As a result, the refrigerant pressure exiting the vortex generator 100 becomes greater than 6 atm, for example, to 8 atm. Thus, the suction pressure of compressor 12 increases, and, accordingly, the compressor work is reduced, increasing the EER of the refrigeration system.

Although the present invention has been described in relation to particular embodiments thereof, many other variations and modifications and other uses will become apparent to those skilled in the art. It is preferred, therefore, that the present invention be limited not by the specific disclosure herein.

What is claimed is:

1. A refrigeration system comprising:

a compressor, a condenser having an input and an output, an expansion device, and an evaporator; said compressor, said condenser, said expansion device, and said evaporator connected in a closed circuit; a mixture of at least a first refrigerant fluid having a first boiling point and a second refrigerant fluid having a second boiling point filling and circulates around said closed circuit;

a fluid separator connected to said output of said condenser, said separator having an inlet and a first outlet in series with said closed circuit, and having a liquid storage volume and a second outlet in communication with said liquid storage volume;

a closed regeneration path connected to said second outlet of said separator and connected to said input of said condenser, said closed regeneration path recirculating a condensed fluid of one of said refrigerant fluids;

and a connection path coupled from said output of said compressor to said liquid storage volume to permit heating of the liquid within said storage volume by fluids from said output of said compressor.

2. The system of claim 1, wherein said separator is a liquid-vapor separator, said first outlet of said liquid-vapor separator is a vapor outlet and said second outlet of said liquid-vapor separator is a liquid outlet.

3. The system of claim 2, which further includes a controllable valve in said connection path to control the flow of heated fluid from said compressor outlet to said liquid storage volume.

4. The system of claim 1, which further includes a second evaporator and a second expansion device connected in series within said closed regeneration path.

5. The system of claim 4, which further includes a vortex generator for coupling the outputs of said evaporators to the input of said condenser.

6. The system of claim 5, wherein said condenser is a first condenser, said system further comprising a second condenser having an input and output in series with said closed circuit, said output of said first condenser connected to said inlet of said fluid separator and said input of said second condenser connected to said vapor outlet of said fluid separator.

7. The system of claim 6, wherein said second evaporator produces a chilled air which is directed to cool said second condenser.

8. The system of claim 6, wherein said second evaporator produces a chilled air which is directed to cool a refrigerated space.

9. The system of claim 8, wherein said first boiling point is higher than said second boiling point.

10. The system of claim 1, wherein said condenser is a first condenser, said system further comprising a second condenser having an input and output in series with said closed circuit, said output of said first condenser connected to said inlet of said fluid separator and said input of said second condenser connected to said vapor outlet of said fluid separator.

11. The system of claim 1, wherein said mixture is R-32, R-125 and R-134a.

12. The system of claim 11, wherein said first refrigerant fluid is R-134a, said R-134a is at least partly liquified in said first condenser and liquid R-134a is recirculated through said closed regeneration path.

13. The system of claim 1, further comprising a valve in said closed regeneration path.

14. The system of claim 1, wherein said first refrigerant fluid is recirculated in said closed regeneration path.

15. The system of claim 1, wherein said second evaporator produces chilled air for movement to cool a more heated volume.

16. The method of operating a refrigeration system, said system having a closed circuit including a compressor, a first condenser having an inlet, a liquid-vapor separator having a liquid outlet, a second condenser, an expansion device, and an evaporator, said system further having a closed regeneration path connected to said liquid outlet of said liquid-vapor separator and connected to said input of said first condenser, said method comprising the steps of:

circulating a mixture of at least a first refrigerant fluid having a first boiling point and a second refrigerant fluid having a second boiling point around said closed circuit;

partially liquefying at least one of said refrigerant fluids in said first condenser;

recirculating said partially liquified refrigerant fluid in said closed recirculation path;

passing another of said refrigerant fluids through said second condenser, while said another of said at least one refrigerant fluids is mostly in a vapor state;

partially liquefying said another of said at least one of said refrigerant fluids in said second condenser;

and preheating the partly liquified refrigerant fluid from said first condenser by adding healed liquid from said first compressor liquid outlet to said partly liquified refrigerant.

17. The method of claim 16, wherein said recirculating step further comprises recirculating said first refrigerant fluid in said closed regeneration path.

18. The method of claim 17, wherein said first boiling point is higher than said second boiling point.

19. The method of claim 18, wherein said recirculating step further comprises recirculating R-134a in said closed regeneration path.

20. The method of claim 19, wherein said second refrigerant fluid is selected from the group consisting of R-32 and R-125.

21. A refrigeration system comprising:

a compressor having an input and an output;

a condenser having an input and an output;

a first and a second evaporator;

a first and a second expansion device;

a mixing chamber device having first and second inputs and an output;

said compressor, condenser, first evaporator, said first input of said mixing chamber and said output of said mixing chamber being connected in a closed series relation;

said compressor, condenser, said second expansion device, said second expansion device, said second evaporator said second input of said mixing chamber and said output of said mixing chamber being connected in a closed series relation; said second evaporator producing a chilled air for cooling said condenser.

22. The system of claim 21, wherein said mixing chamber is a vortex generator.

23. The system of claim 21, which further includes at least one refrigerant which circulates in said closed circuits.

24. The system of claim 23, wherein the pressure at the output of said second evaporator exceeds the output pressure at the output of said first evaporator.

* * * * *